United States Patent [19]

Flynn

[11] Patent Number: 4,754,769

[45] Date of Patent: Jul. 5, 1988

[54] NAIL DRYER

[75] Inventor: Jerome R. Flynn, Anaheim, Calif.

[73] Assignee: Salon Pro, Inc., Anaheim, Calif.

[21] Appl. No.: 711,693

[22] Filed: Mar. 12, 1985

[51] Int. Cl.[4] ..... A45D 29/22; F26B 19/00

[52] U.S. Cl. ..... 132/73.5; 219/521; 34/202

[58] Field of Search ..... 132/73, 73.5; 34/202, 34/243 R; 219/521, 342, 366, 385

[56] References Cited

U.S. PATENT DOCUMENTS

| | | | |
|---|---|---|---|
| 2,389,822 | 11/1945 | Simmons | 34/202 |
| 2,490,019 | 12/1949 | Elliot | 34/202 |
| 2,673,402 | 3/1954 | Chambers | 34/202 |
| 3,930,320 | 1/1976 | Henderson | 34/202 |
| 4,206,556 | 6/1980 | Sabo et al. | 132/73.5 |

FOREIGN PATENT DOCUMENTS

| | | | |
|---|---|---|---|
| 2161330 | 6/1973 | Fed. Rep. of Germany | 132/73.5 |

*Primary Examiner*—John Weiss
*Attorney, Agent, or Firm*—Richard D. Slehofer

[57] ABSTRACT

A nail dryer includes a clamshell shaped base for resting the user's hand thereon. A C-shaped heating member is attached to the perimeter of the base by rib braces. The member includes two separated C-shaped channels housing a rope heater. The ribs form segmented air slots between the base and the channels. A clamshell shaped cover fits over the base and the C-shaped heating member. The closed cover forms an air chamber. The channels also have air induction vents below the heater for allowing outside air to pass by the heater and then to enter the air chamber. Air also enters via the air slots and is heated as it flows by the two channels. The hot air entering the air chamber is deflected by baffles. The wet fingernails are positioned in the chamber, and the hot air flow rapidly bakes the polish. The hot air vents at the cutaway rear of the cover. The stepped fashion of the rope heater and the two channels influence the air flow and currents in the chamber.

3 Claims, 5 Drawing Sheets

NAIL DRYER

BACKGROUND OF THE INVENTION

Because of fashion dictates and to improve their physical appearance, women have for a long time polished their fingernails and toenails. With regard to fingernails, women have allowed them to grow to enhance their physical attributes. Occasionally a woman may chip a long fingernail, necessitating the removal thereof and replacement with an acrylic false nail. After normal use of the hands, the nail polish applied to either the natural or the false nail becomes chipped and otherwise scratched, resulting in a displeasing appearance of the fingernails. As a result of this, the old nail polish has to be routinely be removed and new polish applied, even on a weekly basis.

The typical fingernail, including the false nails, are printed by the application of three coats of an acrylic material which includes a solvent dispersing the pigment therein and a final clear coat for sealing and protecting the third coat covering the color. The acrylic polishes are applied in a liquid form and each layer should be allowed to dry before the succeeding layer is applied in order to achieve a properly coated and sealed fingernail. The traditional means to accomplish this drying is to simply let the liquid polish dry at room temperature. Unfortunately, this requires at least a one-half hour minimum in order for the polish to evaporate and set. There have been attempts to improve or shorten the drying or setting time of the acrylic coatings, such as using a hand held propeller which moves room air over the fingernails, or placing the fingernails underneath a heating lamp. These methods have proven to be unsatisfactory because they dry the various coatings from the upper most layer downwards to the base layer rather than the other way around, as it should be.

SUMMARY AND OPERATION OF THE INVENTION

A nail dryer for drying freshly applied nail polish on the nails of a user includes a base and rest platten for correct positioning of the nails above a rope heater. The rope heater is held in position by a C-shaped member attached to the front perimeter of the base by rib braces. The C-shaped member includes two C-shaped heating channels separated and supported by the ribs creating two C-shaped rows of air slots, one between the base and the first heating channel and the other between the two channels. The channels have induction air vents below the rope heater for allowing outside air to enter and to be heated. The two rows of air slots and the two vented channels provide for the intake of ambient room air.

Attached to the base is a clam shell shaped hinged cover, which has a rear cut-away to provide clearance for the user's hand when the dryer is in use. The rounded edge of the cover slightly overhangs the perimeter of the C-shaped member, forming a circular gap between the two for allowing intake of outside air into the air chamber formed when the cover is closed. Accordingly, there are five concentrically spaced C-shaped air inlets; the interior row of air slots between the base and the first heating channel, the middle row of air slots between the first and second heating channels, the two sets of air induction vents in the channels, and lastly the gap at the cover overhang.

The two channels have induction vents cut out below the rope heater for allowing outside air to enter and rise up past the energized rope heater. The induction vents act as chimneys.

The induction vents have a flared cross-section for allowing the rope heater to be positioned at the flaring and yet allow incoming air to flow past the heater on its way into the air chamber. Projection tabs are placed periodically on both sides of the flaring in each of the induction vents for holding the rope heater in place, and for preventing it from lodging in the flaring, and obstructing the air flow through the induction vent. These staggered projection tabs maintain a clearance on either side of the rope and the walls forming the induction vents. The position of the flarings can be stepped so that the rope heater in the first channel will be at a lower elevation relative to the rope heater in the second channel. This stepping of the two rope heaters alters the fluid flow of the air through the nail dryer. Furthermore, changing the diameter and composition of the rope heater will also alter the fluid flow characteristics of the heated air. The aforementioned stepping of the two rope heaters could also be accomplished by having the first and second heating channels have the same cross-sections including their respective air induction vents. The two channels would be stepped with respect to each other. This could be done by slight modification of the rib braces extending from the base, which hold the two channels in a cantilievered position. A line running through both of the cross-sections of the rope heaters can be fifteen degrees from the horizontal. In other words, the second heating channel would be stepped above the first channel by fifteen degrees.

The base and cantilevered C-shaped member are injection molded from NORYL brand plastic resin. It is a polyphenylene oxide-based resin. NORYL is an excellent heat conductor, and yet maintains its integrity when heated. The rope heater heats the body of both of the heating channels in addition to warming up the entire nail dryer. The incoming air is a laminar flow past all of the air slots. The heat from the rope is conducted to the surface of the air slots where this heat is transferred to the air, causing the air to expand in an updaft. The hot air enters the air chamber and the laminar flow changes to a turbulant flow because of the closed cover and baffles.

The air heated by the rope heater causes an updraft, which in turn pulls in more outside air past the hot rope heater. The heated air rises and flows into the resulting air chamber between the interior ceiling of the closed cover and the upper surface area of the C-shaped member. The interior ceiling of the cover has three concentrically positioned baffles extending downwardly from the ceiling. These baffles deflect and direct the fluid flow of the heated air rising up from the rope heater. The baffles tumble and modify the hot air currents causing the heated air to flow around and past the finger tips and nails jutting out into the air chamber. The underside and substrate of each fingernail is heated first by the rising hot air from the air induction vents and air slots, , and the upper side of the nail is heated by the deflected air from the baffles. This provides for a uniform heating of the fingernails, which ensures that the fresh coats of nail polish and sealer dry in the same order in which they were applied to the fingernails. As the nail polish and sealer dry in response to the circulating hot air, the pigments and solids from an integrated, protective shiny coat on the nails. The volatiles and solvents in the nail polish , which act as carriers for the pigments, evaporate and are interspersed with the flowing heated air. The rear cutaway of the cover provides a clearance above the hand for allowing exit venting of the spent hot air and volatiles to the outside This fluid flow of exhaust gases causes more fresh outside air to be drawn in to the air chamber via the air slots and the induction vents. The drawing in of outside air, heating it and circulating it in the chamber and then venting it out past the rear cutaway is a continuous process while the heater is pluged in.

The hinged cover can be equipped with elevation notches extending below the two side finger tabs. Along the rear edge of the base can be a pin to have one of the notches rest on. The cover is sufficiently flexible so that it can be bent to accomodate any one of the notched positions. By setting the cover at a particular notch, the clearance between the hand and the cut-away is increased, thereby allowing for an increased flow of exit gases and hot air from the air chamber. This will decrease the temperature of the air chamber. The notches provide a way to control the temperature in the air chamber.

The drying time required to dry the traditional four coats of polish is around five minutes. To operate the nail dryer, it must first be plugged into an electrical outlet and allowed to warm up for a few minutes. During the warm-up time the user can be applying the nail polish and sealant. The user then opens the cover by lifting one of the finger tabs on the cover, correctly positions the hand on the platten on the base to ensure that the fingernails extend into the chamber area, and then shuts the cover. The dryer works by itself. After a five minute period the nails are dry, and the hand is withdrawn.

DETAILED DESCRIPTION OF THE PREFERRED EMBODIMENT

Figure 1:
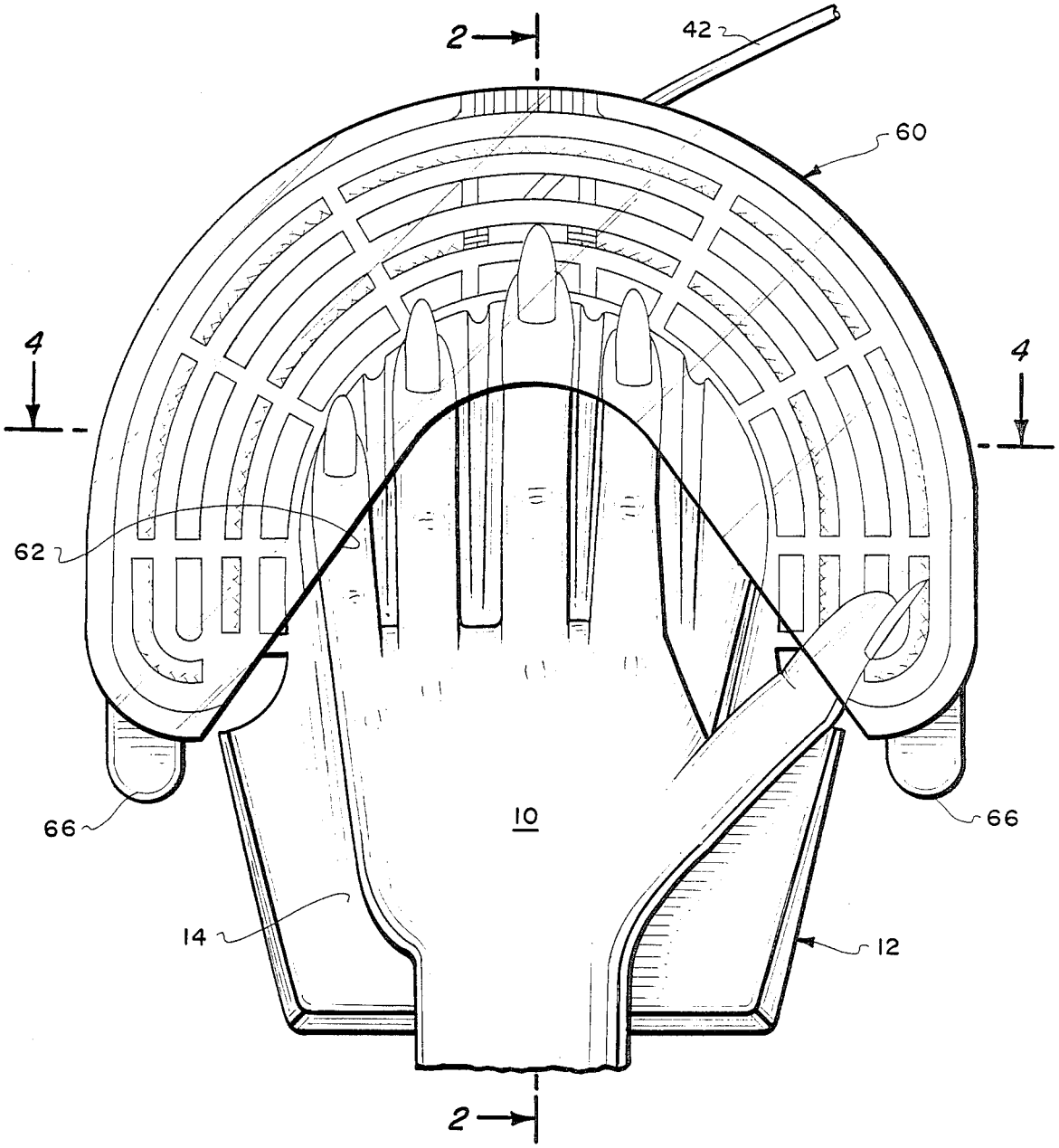
FIG. 1 illustrates the top plan view of the nail dryer with the left hand of the user resting on the base and the cover in place for heating and drying the exposed fingernails.

Referring now to the drawings, FIG. 1 illustrates the nail dryer in actual use having the left hand of the user correctly positioned. FIG. 1 is a top plan view of the device. There is illustrated the left hand 10 which is resting on the molded base 12, said base 12 further having a seating means 14 which is only partially visible because of the hand covering the rest of the seat means 14. The cover means 60 is positioned over the fingernails. The cover means is of a translucent material for illustration purposes in FIG. 1. However, the cover means could be fabricated from an opaque or solid material.

Figure 2:
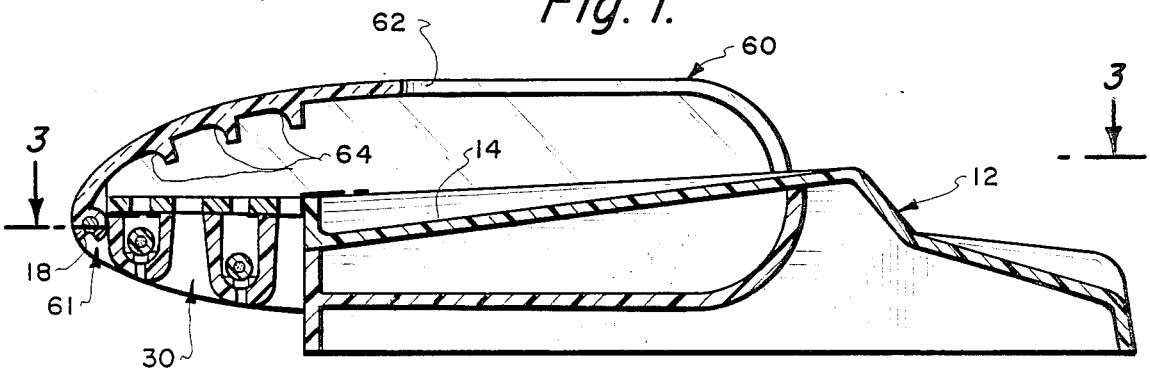
FIG. 2 illustrates a longitudinal cross-sectional view of the nail dryer taken along the lines 2—2 of FIG. 1 and illustrating the nail dryer with the hinged cover in place over the base.

FIG. 2 is a cross-sectional view taken along the lines 2—2 of FIG. 1 with the user's hand omitted. The cover means 60 is described as a clam-shaped cover having a hinge means described at contact point 61 with the hinge 18 attached to the base 12. FIG. 2 will be described in greater detail infra.

Figure 3:
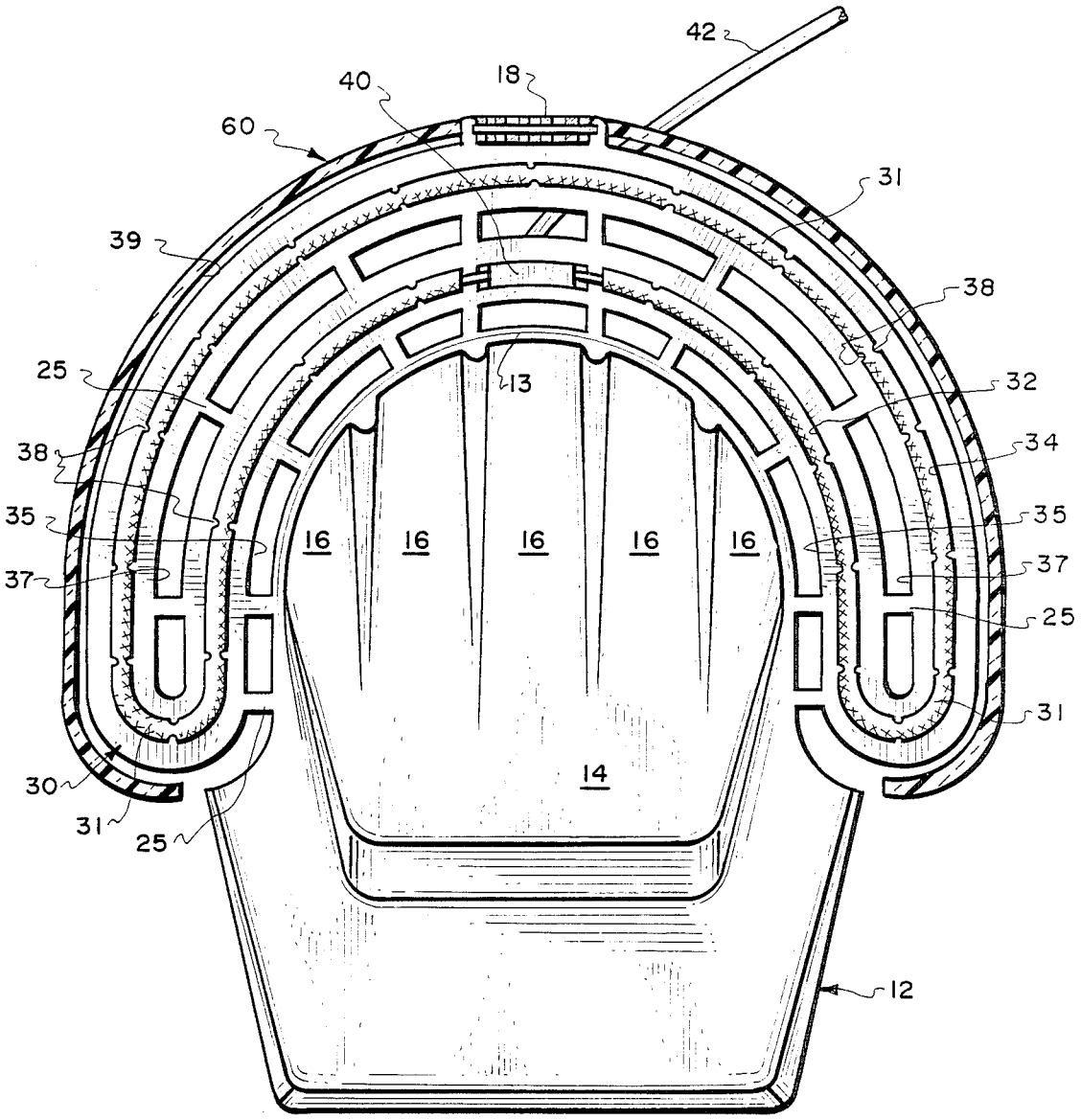
FIG. 3 is a top plan view of the base with the hinged cover cutaway for illustrating the C-shaped member, the rope heater looped within the stepped C-shaped channels and the adjacent air slots.
Figure 5:
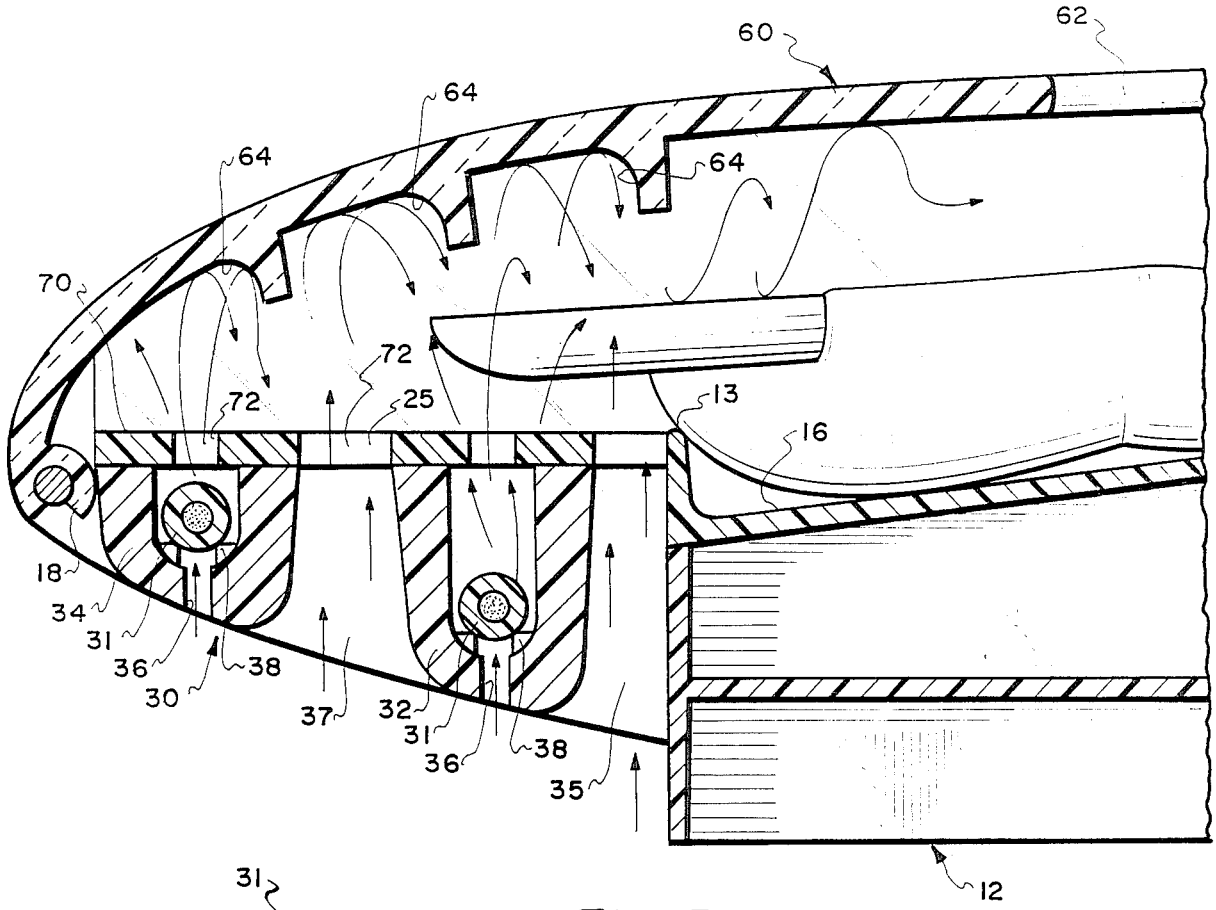
FIG. 5 is an enlarged fragmentary view showing a partial cross-section of the nail dryer while in use with an exposed fingernail showing the relationship between the fingernail, rope heater, the air slots, and the heating chamber.

FIG. 3 illustrates the molded base 12 with the user's hand 10 omitted and the hinged cover 60 cut away. As is clearly illustrated, the seat means 14 is described as a platten having a multiplicity of indentations 16 for providing a place for the user's fingers to be positioned when using the nail dryer. The molded base has attached to its front periphery a heating means generally numbered 30 which is described generally as an overall C-shaped member attached to the molded base by a plurality of rib braces 25. The member 30 is positioned below the user's nails as illustrated in FIGS. 2 and 5. The purpose of this is to allow the heated air to rise up to and around the user's fingernails for heating and curing the wet nail polish.

The heating means, or C-shaped member 30 extending from the molded base 12 in FIG. 3 can be further described as follows. The heating means 30 includes a plurality of C-shaped heating channels. The C-shaped channels are illustrated in the top plan view of FIG. 3. The channel formed adjacent the edge of the base 12 is the first channel 32. Attached to the first channel by the ribs 25 is the second heating channel 34. Channels 32 and 34 support the looped heating element 31 described as a fiberglass sheathed nichrome rope heater.

The first channel 32 is cantilevered away from the perimeter of the base 12. The radial ribs 25 form a series of segmented air slots generally labelled as the inside C-shaped air slot series 35. There is another series of C-shaped air slots formed between the first and second channels 32 and 34. This middle series of air slots is labelled 38 and is also segmented by the extending rib braces 25.

In an alternative embodiment, the cross section of these C-shaped channels and air slots are more clearly illustrated in the enlarged fragmentary view of FIG. 5. The first channel 32 includes a heat induction vent 36 placed below the lower looped rope heater 31. The second channel 34 also includes an induction vent 36 which provides air flow past the upper half of the rope heater 31. All four of the heating channels and air slots are described as concentrically positioned C-shaped channels or slots and are braced together by the ribs 25. Further, each C-shaped entity is larger than the preceeding one. The two channels 32 and 34 are in a stepped fashion. The heating element 31 is illustrated as a rope heater which begins at anchor point 40 and is connected to an AC outlet cord 42. The rope heater is threaded in the first channel 32 and loops onto the other second channel 34. It loops back into the first channel 32 and terminates where it begins by being connected with the other lead of the AC wire 42.

Figure 6:
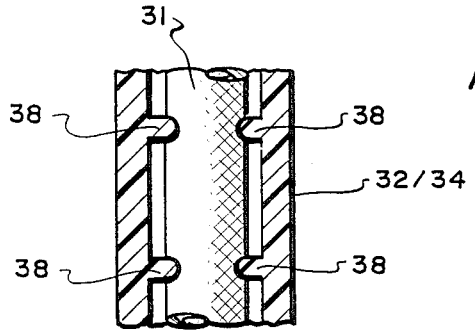
FIG. 6 is a fragmentary underside view of the rope heater in the C-shaped channel and being held in position by the projection tabs in the C-shaped channel.

FIG. 6 is a fragmentary underside view of the rope heater 31 in position in either channel 32 or 34. There is illustrated a series of bilateral projection tabs 38 which hold the rope heater in place and prevent it from dislodging. The fiberglass sheathing catches between each set of bilateral tabs.

Figure 4:
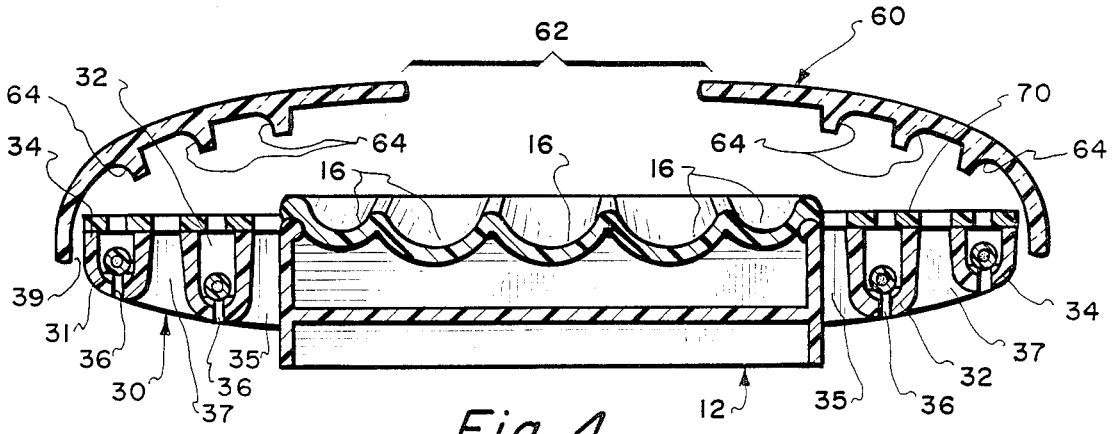
FIG. 4 is a transverse cross-sectional view taken along the lines 4—4 of FIG. 1.

FIG. 4 is the cross-sectional view taken along the lines 4—4 of FIG. 1. FIG. 4 shows the spatial relationship between both halves of the rope heater 31 and the crosssections of the air slots 35 and 37. In FIG. 4 the two faces of the channels 32 and 34 are at the same horizontal level with respect to each other and to the base. The two series of air slots have tapered side walls. The relationship of the looped rope heater, the heat induction vents and the air slots can be explained as follows.

Figure 7:
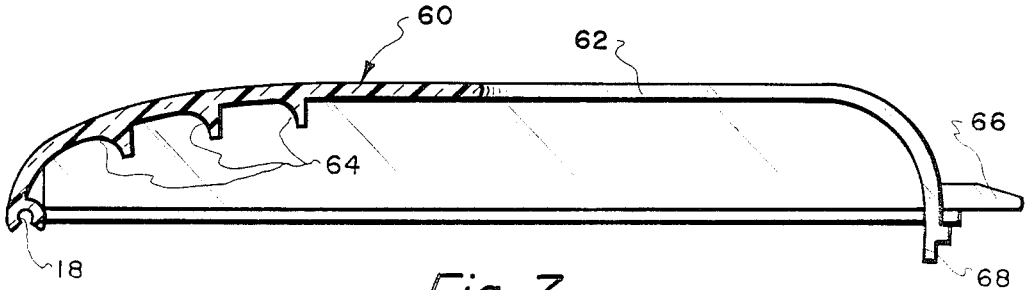
FIG. 7 is a longitudinal cross-sectional view of the modified version of the cover illustrating the lift tabs and adjustment notches.
Figure 8:
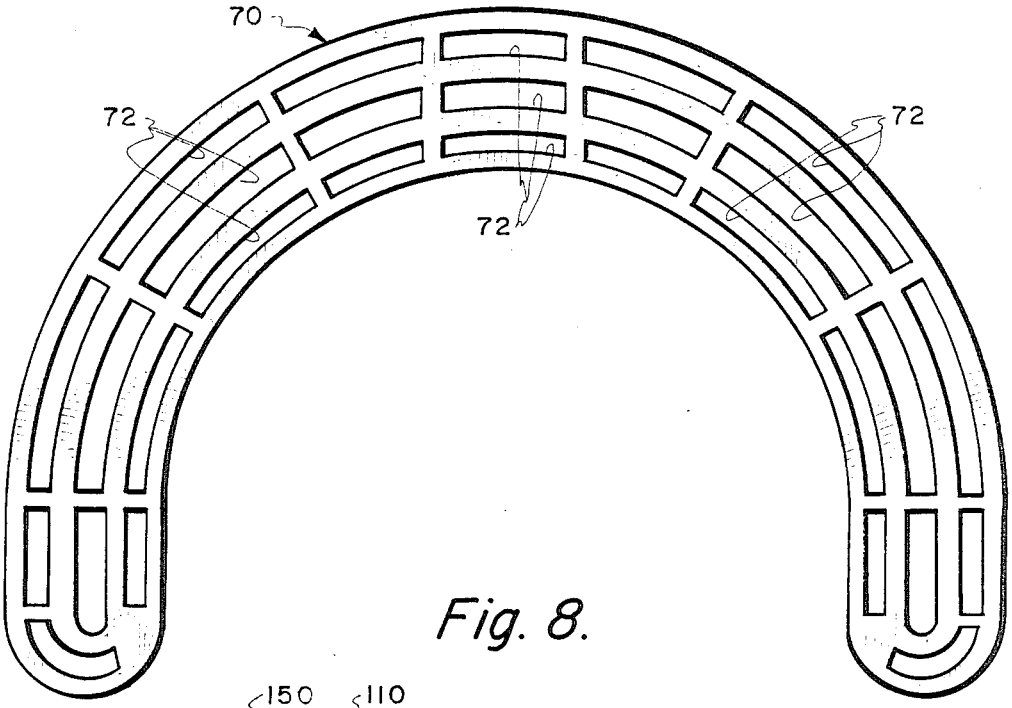
FIG. 8 is a top plan view of the vented rope heater retaining plate/safett plate.

The nail dryer is intended to be used in a room having an air temperature range between 65 degrees to 80 degrees. The nail dryer is plugged into an AC outlet and is allowed to warm up for approximately 5 minutes to allow the rope heater to come up to its operating temperature. An on and off rheostat is not required. The rope heater draws in air from the induction vents 36, past the rope heater 31 and up into an air chamber which is formed between the cover 60 and the C-shaped member. As the heated ambient air is tumbled around the air chamber, the fluid flow of the air eventually works its way out of the rear cover cut-away 62 and vents back into the room. This convection fluid flow continues so long as the rope heater is heated by the AC outlet plug. The interior of the hinged cover includes a curved interior ceiling means described as an interior curve having baffles 64 projecting from this inside surface. As illustrated in FIG. 5, there are three baffles which are strategically positioned so that the fluid flow of the heated air will be directed and tumbled so that the fluid flow tends to have an eddylike effect and remain in the air chamber for a period of time thereby heating the wet fingernails exposed in this heating chamber. The fluid flow of the convection heated air will eventually exit past the last baffle and work its way past the upper surface of the inserted hand and out through the cut-away 62 of the nail cover. The nail cover has a longitudinal cross section disclosed in FIG. 7. The nail cover 60 has a hinge 18 and there is disclosed in FIG. 7 at least one fingernail tab 66 for convenience in opening and closing the nail cover. Below the tab are three notches 68 which interact with stops attached to the base. These notches allow the nail cover to be slightly ajar to modify the fluid flow of this heated air. The perimeter of the nail cover is clearly shown in the cut-away plan view of FIG. 3. There is a gap between the edge caused by the overhang of the cover and the outer edge of the C-shaped member 30 which also provides for an intake for ambient air. The cavities of the first and second channels 32 and 34 allow the rope heater 31 to be suspended in place above the vents 36. The rope heater is comprised of a nichrome element having a fiberglass sheath. The ambient air can pass through the induction vents 36 past the nichrome rope heater and into the air chamber. The exposed heated rope heater can pose a safety hazard to the user and accordingly FIG. 8 illustrates a vented rope heater retaining plate/safety plate 70 for maintaining the rope heater in the first and second channels and also to prevent the finger or toe from contacting the rope heater. The retaining plate is slotted 72 so that the heated air will still flow past the rope heater and up into the chamber. The rope heater is still exposed but the retaining plate creates a safety margin of about ⅛" from the top of the channels, and the rope heater is positioned down within the channels so that there is no likelihood of contact between the fingers or toes and the rope heater.

Figure 10:
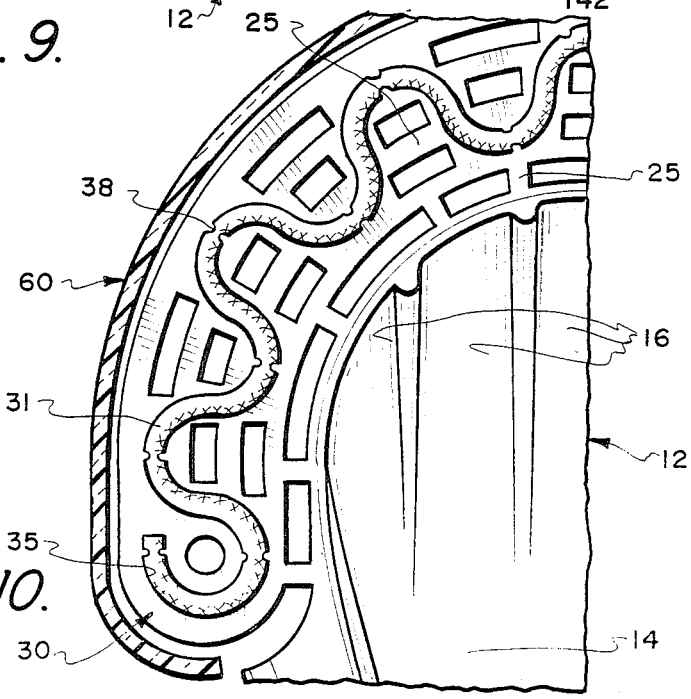
FIG. 10 is a perspective view of an alternative embodiment of the nail dryer illustrating a serpentine wound rope heater.

Another embodiment of this rope heater is disclosed in FIG. 10. FIG. 10 shows a top fragmentary view of the C-shaped member 30. Instead of having concentrically C-shaped channels for holding the rope heater and a retaining plate above them, there is disclosed a rope heater 31 which is wound in a serpentine fashion on the C-member 30. The C-shaped channel is formed snake-like in a serpentine fashion having adjacent air slots where possible. The rope heater is laid out in the serpentine, C-shaped channel 35. The ambient air is still allowed to enter in the air slots between the serpentine shaped channel and also between the opening at the overhang of the cover.

Figure 11:
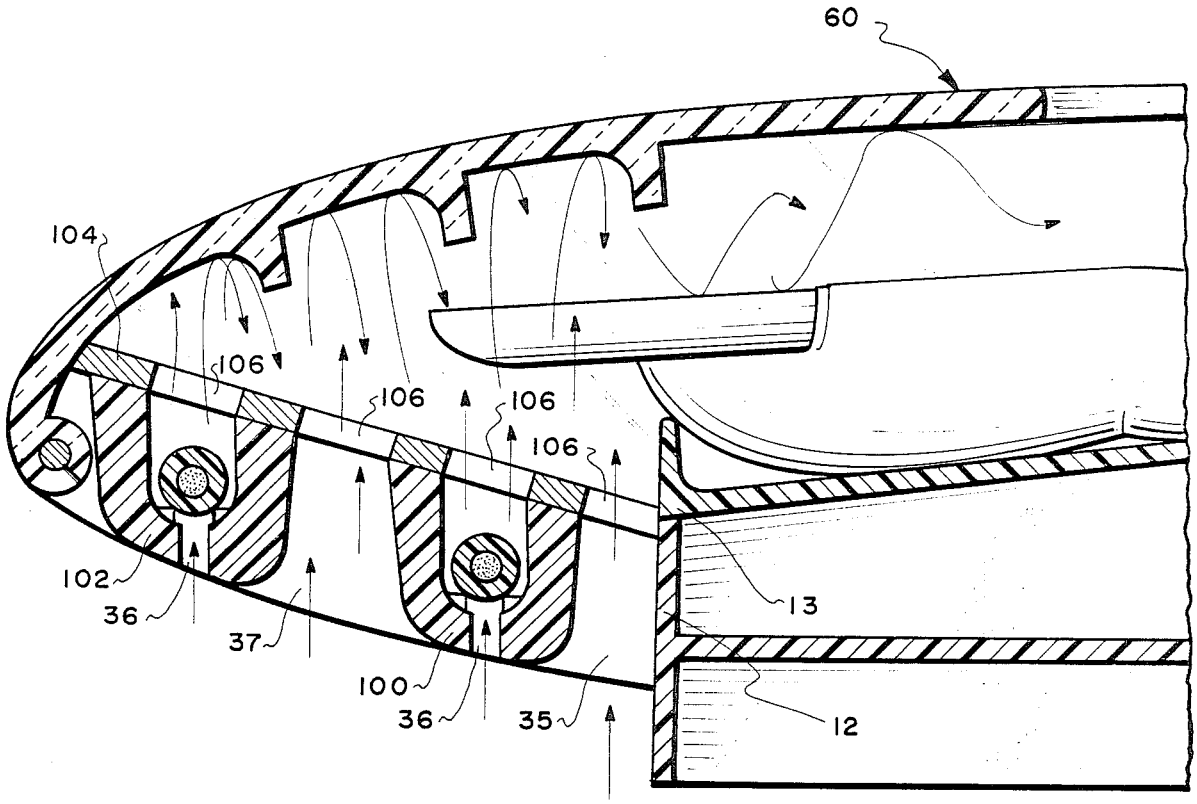
FIG. 11 is an alternative embodiment of the C-shaped member shown in FIG. 5. The faces of the heating channels are angularly cut.

Referring now to FIG. 11. FIG. 11 differs from FIG. 5 in that the two heating channels 100 and 102 have both of their faces angularly cut at 15 degree angle, which is the same angle that the two levels of the rope heater are stepped to each other. The 15 degree angle has been experimentally found to be the preferred offset. However, other angles should prove to be acceptable. The safety plate 104 is the same plate as plate 70 with a slight modification. The air slots 106 are somewhat larger so that they do not overhang into the air passages 35, 37, and 36 and restrict air flow. The edges of the air slots 106 direct the flow of the heated updrafting air towards the baffles 64. This is to intensify the eddy-like fluid flow in the air chamber. The continued swirling and turbulent air flow causes an increased air flow around the fingernails, thereby accelerating the curing and setting of the nail polish and sealer painted on the nails. The end result is a better quality finish in less amount of time. The air currents are graphically illustrated by the arrows in the air chamber.

There is also disclosed in FIGS. 5 and 11 a stop means at the forward edge of the platten 16. The stop means 13 is described as a ridge for indicating to the user that finger tips should not intrude past this ridge 13. This will ensure that the fingernails are in the correct drying position.

Figure 9:
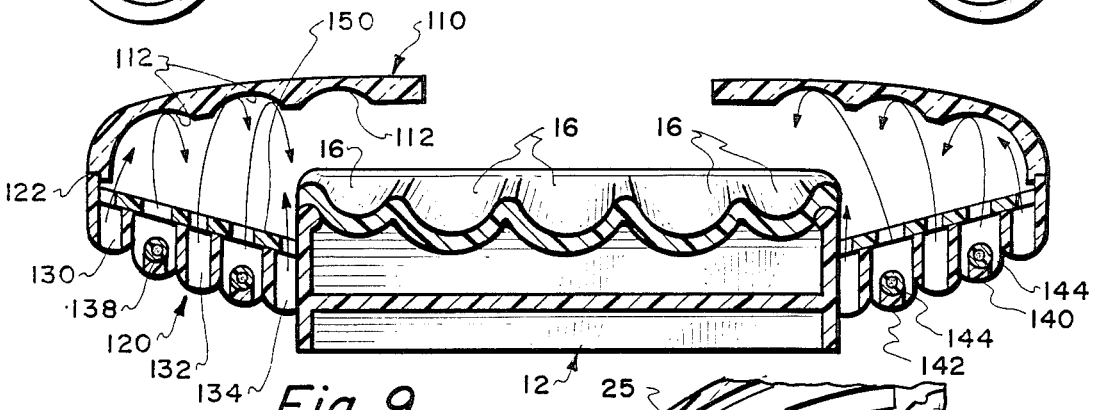
FIG. 9 is a transverse crossectional view of another alternative embodiment of the Cshaped member and the cover.

FIG. 9 discloses another embodiment of the nail dryer. FIG. 9 is a transverse cross-sectional view. The hinged cover 110 has three concentric grooves 112 in the interior ceiling which serve the same purpose as the baffles 64. The grooves 112 modify the updraft to create turbulence and an eddy-like effect in the air chamber so that it results in a greater volume and movement of air around the exposed fingernails. The C-shaped heating member is generally labelled 120. The cover 110 fits snug against the perimeter 122 of member 120. This is in contrast to the overhang and gap between the cover 60 and the perimeter 39 of the member 30 in the other embodiments. This gap allows for outside air intake into the chamber. Instead of the overhanging cover, there is provided another air slot 130. The other two concentric air slots are 132 and 134. They are concentrically positioned with respect to each other and are in a stepped fashion. The rope heater 138 is looped in two channels 140 and 142, which are separated by air slot 132. The channels 140 and 142 have narrow segmented air slots 144 cut out on either side of the rope heater for allowing outside air to flow past the hot rope heater. The narrow slots 144 serve the same function as air induction vents 36 do in the other embodiments disclosed. The safety/-retaining plate 150 has a plurality of cutout slots for allowing air flow into the air chamber. The face of the C-shaped member 120 slopes upwardly as it moves away radially from the perimeter of the base, and results in a stepping of the rope heater.

The base 12 and the attached C-shaped member 30 could be molded so that the rib braces 25 are eliminated. The two components would appear to be an integrated housing and having an overall clam shell like shape. The heating channels and the air slots would appear to be openings on the underbelly of the base, or housing.

The most economical method of the manufacture of the device is by injection molding of the base and the C-shaped member in one piece. The cover is injection molded as a single piece.

Whereas the present invention has been shown and described herein in what is conceived to be the best mode contemplated, it is recognized that departures may be made therefrom within the scope of the invention which is therefore not to be limited to the details disclosed herein but is to be afforded the full scope of the invention.

What is claimed is:

1. A nail dryer comprising:

a molded base;

seat means on said base for resting the hand and positioning the fingers or foot and toes while drying the nails;

cover means attached to said base for forming an air chamber;

heating means attached to said base for convection heating of the outside air, and for providing a plurality of openings into said air chamber;

said heating means being positioned in front of and below the level of said seat means;

said heating means further comprising:

a heating element in combination with a plurality of air slots to draw the ambient air from below and the into said air chamber whenever said heating element is energized;

each of said air slots having a tapered opening for creating a venturi result on the incoming air;

channel means adjacent to said air slots for housing a heating element;

said channel means further comprising at least two concentrically positioned generally C-shaped channels being held in position by rib braces extending from said base;

said C-shaped channels being in a stepped fashion relative to said base, said one C-shaped channel being at the lower level, and said other C-shaped channel being at the next higher level;

heat induction vents in said channels and positioned below said heating element.

2. A nail dryer comprising:

a molded base;

seat means on said base for resting the hand and positioning the fingers or foot and toes while drying the nails;

cover means hingedly attached to said base for forming an air chamber;

said cover means further comprising a curved interior ceiling means for regulating the heated air flow in said chamber towards the fingers or toes;

said ceiling means further comprising a plurality of baffles for regulating said heated air flow for heating various fingernail and toenail lengths;

finger lift tab means for raising and closing said cover means;

said cover means being cut away for providing entrance of the fingers or toes into said air chamber and for exhausting the heated air;

heating means attached to said base for convection heating of the outside air, and for providing a plurality of openings into said air chamber;

heat control means for adjusting the flow of heated air in said heating chamber;

said heat control means including means for modifying the venting of said heated air.

3. A nail dryer comprising:

a molded base;

seat means on said base for resting the hand and positioning the fingers or foot and toes while drying the nails;

cover means attached to said base for forming an air chamber;

heating means attached to said base for convection heating of the outside air, and for providing a plurality of openings into said air chamber.

said heating means being positioned in front of and below the level of said seat means;

said heating means includes a rope heater comprising a fibreglass covered nichrome heating element;

step ladder means for adjusting the vertical height of said cover relative to said base for regulating and controlling the exhaust air from said air chamber.

* * * * *